US006203374B1

(12) United States Patent
Huang et al.

(10) Patent No.: US 6,203,374 B1
(45) Date of Patent: Mar. 20, 2001

(54) RELIABLY ASSEMBLY FOR HIGH DENSITY CONNECTOR

(75) Inventors: Wayne Huang, Alhambra, CA (US); Kuo Cheng Wang; Lipei Huang, both of Tu-Chen (TW); Jones Fun, Shun-Lin (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/452,762

(22) Filed: Dec. 1, 1999

(30) Foreign Application Priority Data

Dec. 31, 1998 (TW) ..... 87222079

(51) Int. Cl.[7] ..... H01R 13/648
(52) U.S. Cl. ..... 439/607; 439/571
(58) Field of Search ..... 439/607, 609, 439/79, 541.5, 25, 567, 571, 564, 572, 573

(56) References Cited

U.S. PATENT DOCUMENTS 5,249,974 * 10/1993 Wang ..... 439/79
5,540,598 * 7/1996 Davis ..... 439/79
5,630,730 * 5/1997 Wang et al. ..... 439/567
6,012,954 * 1/2000 Wu ..... 439/752

* cited by examiner

*Primary Examiner*—Gary Paumen
*Assistant Examiner*—Ross Gushi
(74) *Attorney, Agent, or Firm*—Wei Te Chung

(57) ABSTRACT

A high density electrical connector of the present invention comprises a dielectric housing having a pair of retaining walls rearwardly extending therefrom, a contact module assembly received between the retaining walls, a metallic shield covering a front side of the housing, a pair of grounding portions received in the housing and a pair of metallic attaching portions for electrically connecting the shield to the grounding portion and thence to ground. The attaching portions each have a block which forms a shoulder on a lateral end thereof and a tubular part forwardly depending from the block. In assembly, the shoulders press against joining plates of the grounding portions which are supported by the retaining walls thereby guiding the tubular part and correcting offset of the grounding portions. The shoulders press against the joining plates further preventing the attaching portions from relaxing out of position after assembly. Therefore, assembly efficiency is increased.

3 Claims, 4 Drawing Sheets

RELIABLY ASSEMBLY FOR HIGH DENSITY CONNECTOR

BACKGROUND OF THE INVENTION

The present invention relates to a high density connector, and particularly to a high density connector with a grounding portion and an attaching portion.

With recent developments in communications, interference in an increasing range of signals is a more important problem. To guard against such interference, high density connectors are covered with conductive shields. An attaching means is generally used to connect a shield to ground.

Referring to FIG. 3, a previous high density connector as disclosed in the copending application Ser. No. 09/053,417 filed Apr. 1, 1998 having some common applicants with the invention, comprises a dielectric housing 82, a conductive shield 81 covering a front end of the housing 82, a pair of conductive grounding portions 83 and a pair of conductive attaching portions 84. The attaching portions 84 connect the shield 81 and the grounding portion 83 thereby locking the shield 81, the housing 82 and the grounding portion 83 together. A pair of retaining holes 821 is respectively disposed in lateral ends of the housing 82. A pair of holes 811 is respectively defined in lateral ends of the shield 81. A joining plate 833 of each grounding portion 83 joins an opening plate 834 thereof and a soldering body 832 thereof soldered to a PCB. The opening plates 834 each define an opening 831. The openings 831 are aligned with the retaining holes 821 and the holes 811. The attaching portion 84 includes a tubular part 841 and a block 842 at an end of the tubular part 841.

Further referring to FIG. 4, in assembly, the tubular parts 841 sequentially extend through the openings 831 of the grounding portions 83, the retaining holes 821 of the housing 82 and the holes 811 of the shield 81 and are then riveted against the shield 81. Thus, the attaching portions 84 electrically connect the shield 81 to ground with the grounding portions 83. However, the blocks 842 of the attaching portions 84 fail to abut against the joining plates 833 of the grounding portions 83 and to correct offsets of the joining plates 833 during assembly thereby adversely affecting coplanarity between the soldering bodies 832 of the grounding potions 83 and the PCB during soldering. Furthermore, when the attaching portion 84 is riveted without being firmly pre-positioned, it is possible that the attaching portion 84 will relax from the selected position thereby reducing assembly efficiency.

BRIEF SUMMARY OF THE INVENTION

A first object of the present invention is to provide a high density connector which is adapted to positively retain a grounding portion in position;

A second object of the present invention is to provide a high density connector which prevents attaching portions from relaxing during and after assembly to improve the assembly efficiency.

A high density electrical connector of the present invention comprises a dielectric housing defining a pair of retaining holes in lateral ends thereof, a metallic shield covering a front mating face of the housing and having a pair of holes in lateral ends thereof, a contact module assembly received in a receiving cavity of the housing, a pair of grounding portions each defining an opening, and a pair of conductive attaching portions. The holes of the shield, the retaining holes of the housing and the openings of the grounding portions are coaxial. The grounding portions each include an engaging body with the opening, a soldering body and a joining plate which connects the engaging body and the soldering body. Each of the attaching portions comprises a block with a shoulder on a lateral end thereof and a tubular part depending from the block. The shoulders engage with the joining plates and help secure the grounding portions in place. In assembly, the tubular parts of the attaching portions extend through the openings of the grounding portions, the retaining holes of the housing and the holes of the shield and are riveted against the shield. Because the tubular parts are guided by their shoulders resting against the joining plates of the grounding portions, offset from the axis of the holes, the retaining holes and the openings is avoided. Relaxation of the tubular parts during and after assembly is also prevented thereby improving assembly efficiency.

Other objects, advantages and novel features of the invention will become more apparent from the following detailed description of the present embodiment when taken in conjunction with the accompanying drawings.

DETAILED DESCRIPTION OF THE INVENTION

Figure 1:
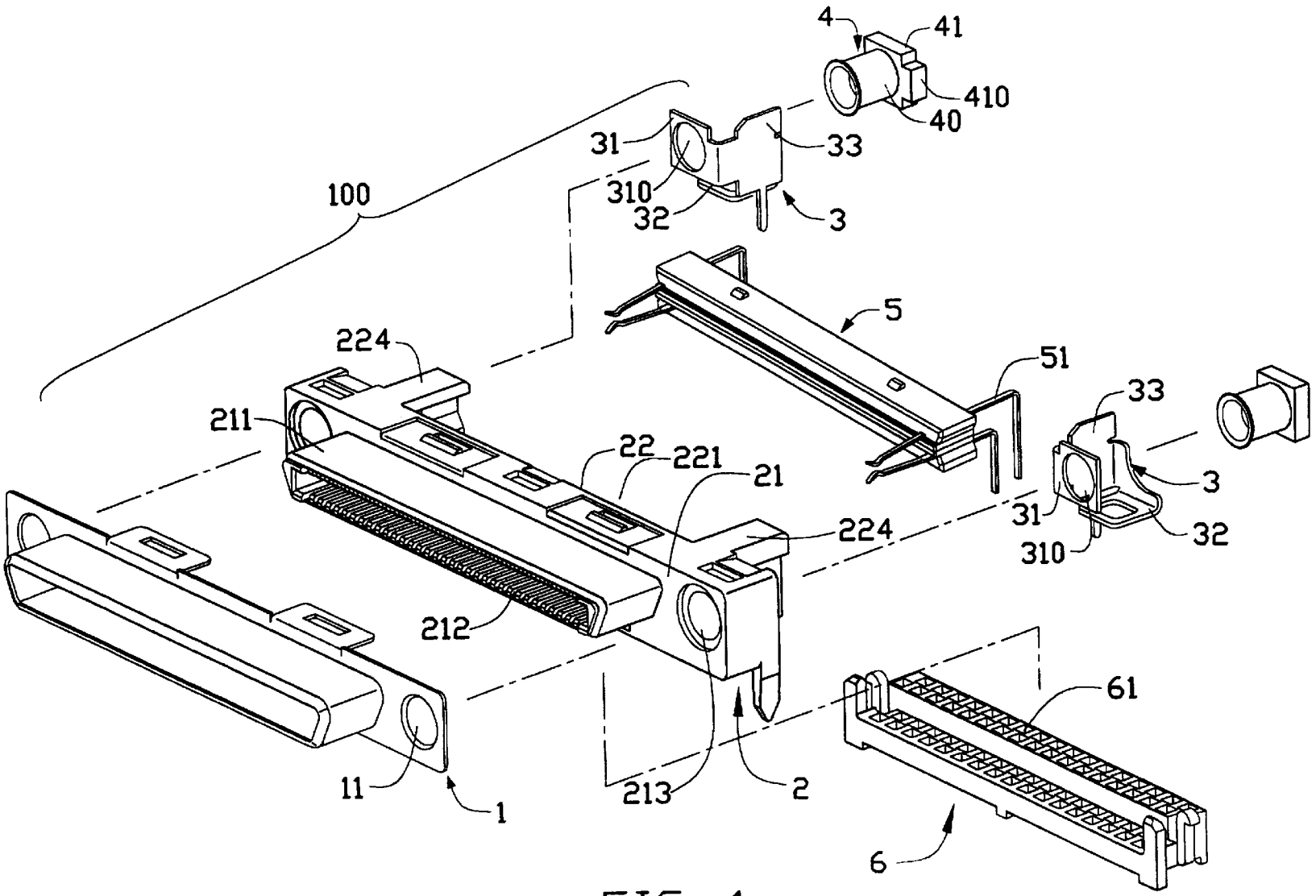
FIG. 1 is an exploded view of an electrical connector in accordance with a first embodiment of the present invention.
Figure 2:
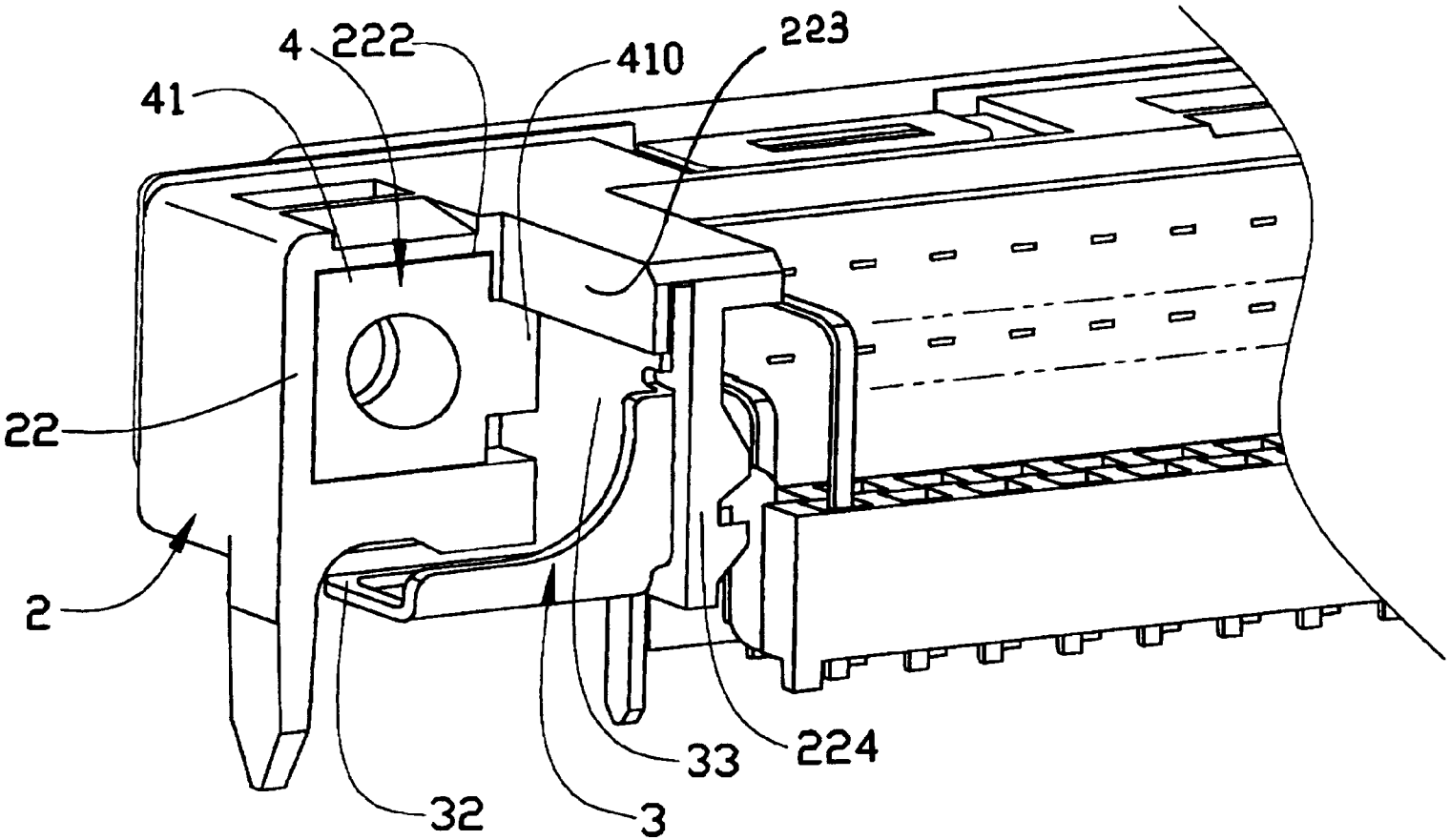
FIG. 2 is a partial enlarged view of the assembled electrical connector of FIG. 1.
Figure 3:
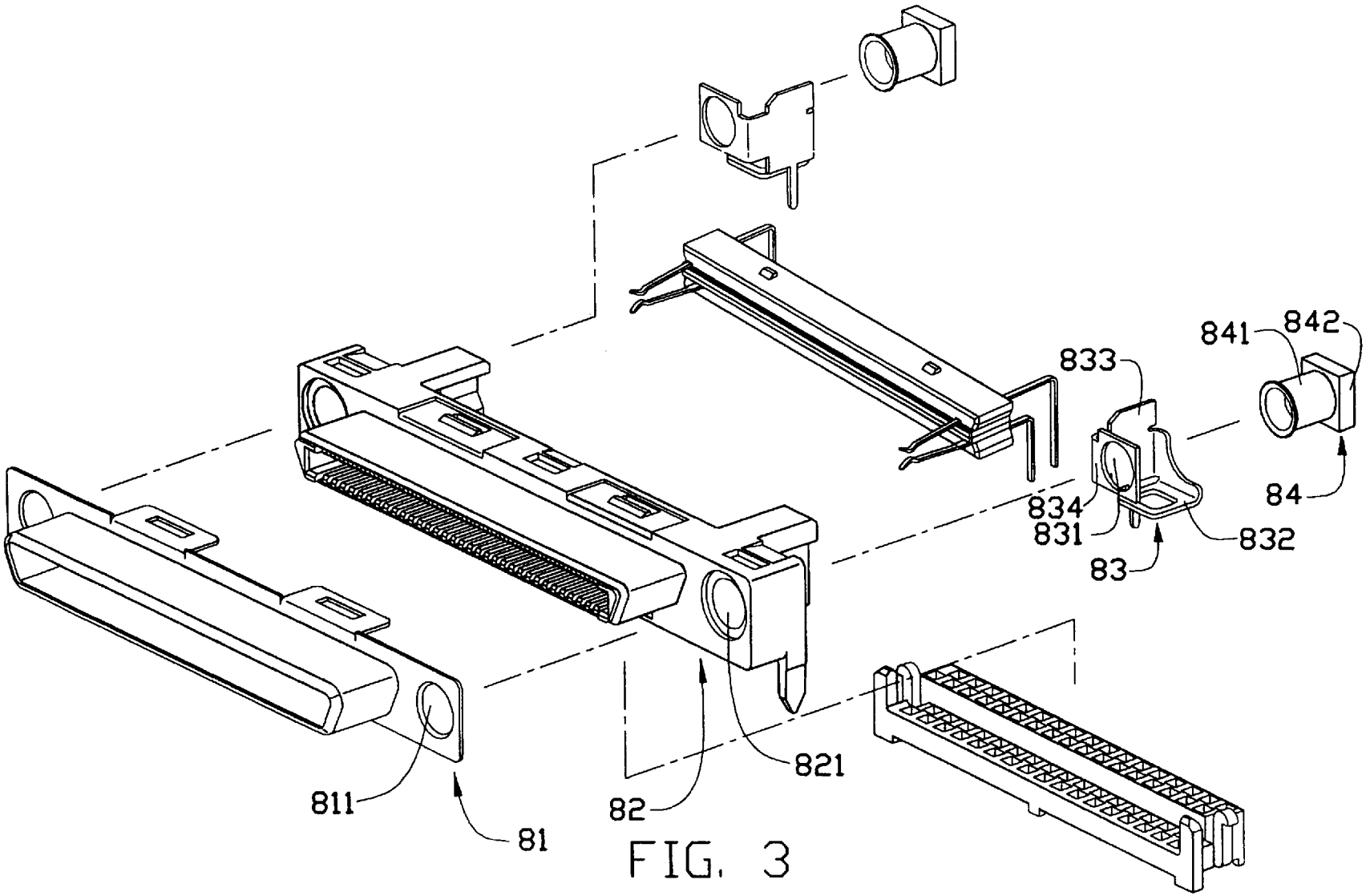
FIG. 3 is an exploded view of a previous electrical connector.
Figure 4:
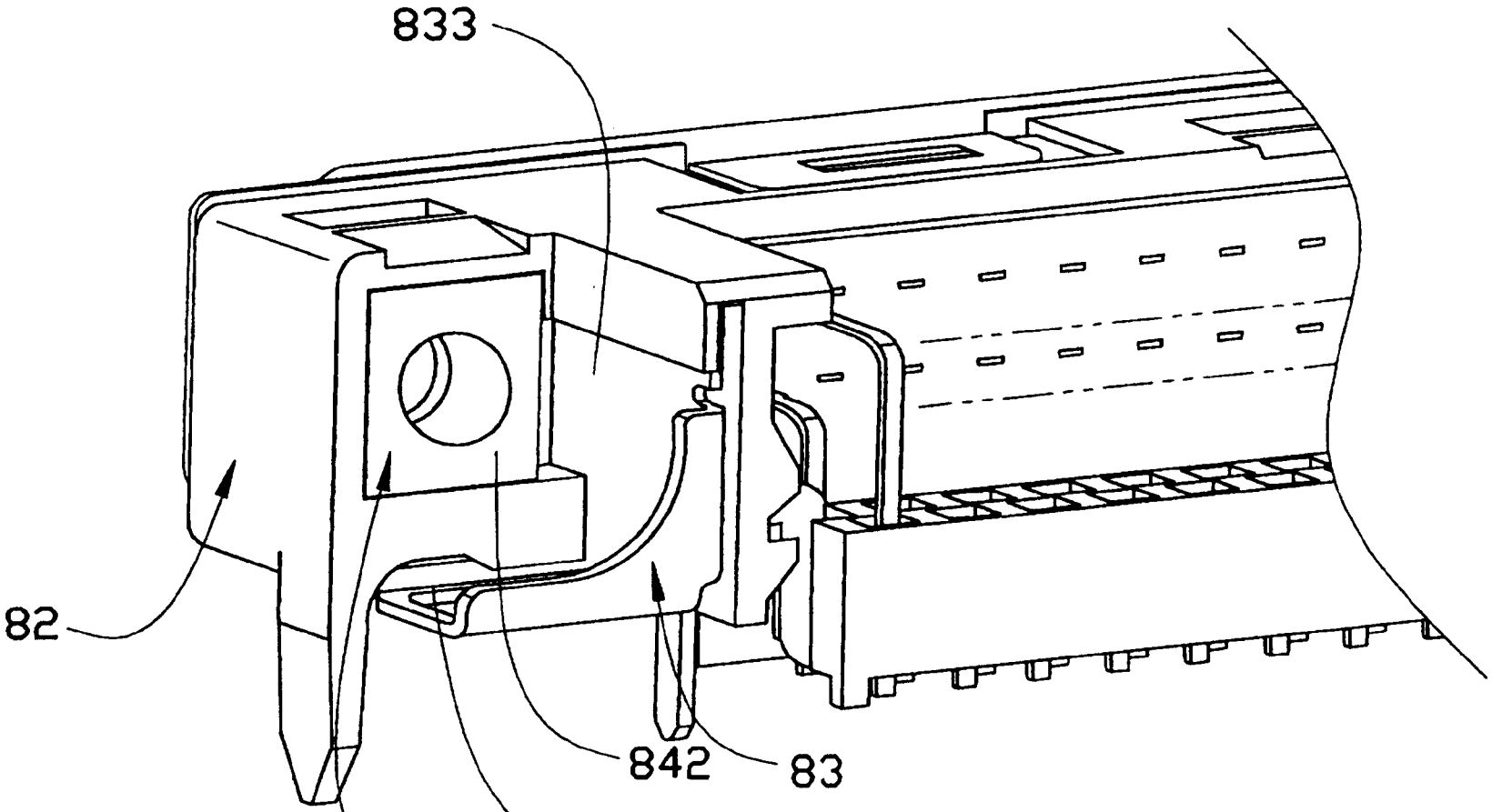
FIG. 4 is a partial enlarged view of the assembled previous electrical connector of FIG. 3.

Referring to FIGS. 1 and 2, an electrical connector 100 in accordance with a preferred embodiment of the present invention comprises an insulative housing 2, a conductive shield 1 covering a front side of the housing 2, a contact module assembly 5 with an insulative spacer 6 received in the housing 2, and a pair of grounding portions 3 and attaching portions 4. The elongate housing 2 has a mating face 21 at a front side thereof and a connecting face 22 at an opposite side thereof. A projection 211 depends forwardly from the mating face 21 of the housing 2 and defines a receiving slot 212 penetrating from a forward edge thereof to the connecting face 22. A pair of retaining walls 224 extends rearwardly from the connecting face 22 of the housing 2 and defines a receiving cavity 221 therebetween for receiving the spacer 6 and the contact module assembly 5. The receiving slot 212 is in communication with the receiving cavity 221. A pair of retaining holes 213 is defined in the lateral ends of the housing 2 and is in communication with a pair of recesses 222 in a rear side of the housing 2.

The shield 1 covers the projection 211 and defines a pair of holes 11 in lateral ends thereof. The holes 11 and the retaining holes 213 in the housing 2 are coaxial and are equal in diameter.

Each of the grounding portions 3 fits in a recess 222 of the housing 2 and includes a joining plate 33 connecting an engaging body 31 and a soldering body 32 thereof. An opening 310 is defined in the engaging body 31. The openings 310 and the retaining holes 213 of the housing 2 are coaxial and are equal in diameter. The soldering bodies 32 are adapted to be soldered on a PCB (not shown) for mounting the connector 100 thereon.

The conductive attaching portions 4 each include a tubular part 40 and a block 41 at an end of the tubular part 40. The tubular parts 40 are adapted to extend through the openings 310 of the grounding portions 3, the retaining holes 213 of the housing 2 and the holes 11 in the shield 1. A shoulder 410 extends from a lateral end of the block 41. The rectangular blocks 41 and the shoulders 410 of the attaching portions 4 mate with the recesses 222 of the housing 2 and the shoulders 410 press against the joining plates 33 of the grounding portions 3, thereby aiding in reliably retaining the grounding portions 3 in position to facilitate soldering of the soldering bodies 32 of the grounding portions 3 to the PCB and assuring proper alignment of the tubular parts 40 during and after assembly.

The spacer 6 defines a plurality of receiving holes 61 for receiving a mounting end (not labeled) of the terminals 51 of the contact module assembly 5.

In assembly, firstly, the contact module assembly 5 and the spacer 6 are received in the receiving cavity 221 of the housing 2. The shield 1 is attached to a front side of the housing 2 and the holes 11 thereof are aligned with the retaining holes 213 of the housing 2. Secondly, the grounding portions 3 are fit in the recesses 222 of the housing 2 and the openings 310 thereof are aligned with the retaining holes 213 and the holes 11. The joining plates 33 of the grounding portions 3 abut against outer surfaces of the retaining walls 224. The tubular parts 40 of the attaching portions 4 are then inserted sequentially through the openings 310, the retaining holes 213 and the holes 11 under guidance of the shoulders 410 of the attaching portions 4. Because the shoulders 410 press against the joining plates 33 and also optimally engageably move along the underside of the channel bar 223 of the housing 2 during assembly, the tubular parts 40 are guided to correct alignment and so offset of the tubular part 40 from the correct axes is avoided. The tubular parts 40 are then riveted against the shield 1. The grounding portions 3 and the shield 1 are connected by the attaching portions 4 for electrical grounding. The joining plates 33 are stiffened by the shoulders 410 thereby positively retaining the grounding portions 3. Even if the attaching portions 4 move during assembly, friction between the attaching portions 4 and joining plates 33 will resist any relative movements of the attaching portions 4 and thus prevent the attaching portion 4 from relaxing out of position.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A high density electrical connector comprising:

an elongate insulative housing defining a pair of retaining holes in lateral ends thereof and a pair of recesses at rearwardly lateral ends thereof; a plurality of terminals received in the housing; a conductive shield covering a front end of the housing and having a pair of holes defined in lateral ends thereof; a pair of grounding portions each mounted to the housing and including a joining plate, an engaging body defining an opening therein, and a soldering body; and a pair of metallic attaching elements fit in the recesses of the housing each including a tubular part extending through the openings in the grounding portions, the retaining holes in the housing and the holes in the shield, and a block at an end of the tubular part;

said connector being characterized in that a shoulder is formed at a lateral end of the block to press against the joining plate of the grounding portion, thereby positively retaining the grounding portions to the insulative housing.

2. The high density electrical connector of claim 1 wherein said shoulder is rectangular shaped and has a planar side for abutting against the joining plate of the grounding portion.

3. An electrical connector comprising:

an elongated insulative housing defining a pair of retaining holes in opposite lateral ends thereof;

a plurality of terminals disposed in the housing;

a conductive shield covering a front end of the housing with a pair of holes defined in opposite lateral ends thereof in alignment with the corresponding retaining holes of the housing;

a pair of grounding members respectively attached to the housing adjacent to the lateral ends thereof, each of said grounding members including a joining plate bridging an engaging body with an opening therein and a soldering portion, all the joining plate, the engaging body and the soldering portion being perpendicular one another; and a pair of metallic attaching elements respectively attached to the housing adjacent to the lateral ends thereof, each of said attaching elements including a planar block and a tubular part therefrom extending through the corresponding opening, retaining hole and hole; wherein said block further includes a shoulder extending integrally therefrom toward the other distal lateral end of the housing, and said shoulder is engageably moved along an underside of a corresponding adjacent channel bar of the housing during assembling the connector, and effectively abuts against the corresponding joining plate aside after the connector is assembled.

* * * * *